US009901941B2

(12) United States Patent
Prus et al.

(10) Patent No.: US 9,901,941 B2
(45) Date of Patent: Feb. 27, 2018

(54) ELECTROSTATIC SPRAY DEVICE FOR SPRAYING A LIQUID COATING PRODUCT, AND SPRAY FACILITY COMPRISING SUCH A SPRAY DEVICE

(71) Applicant: SAMES TECHNOLOGIES, Melylan (FR)

(72) Inventors: Eric Prus, Grenoble (FR); Didier Chevron, Moirans (FR)

(73) Assignee: SAMES KREMLIN, Meylan (FR)

( * ) Notice: Subject to any disclaimer, the term of this patent is extended or adjusted under 35 U.S.C. 154(b) by 112 days.

(21) Appl. No.: 14/784,837

(22) PCT Filed: Apr. 18, 2014

(86) PCT No.: PCT/EP2014/057995
§ 371 (c)(1),
(2) Date: Oct. 15, 2015

(87) PCT Pub. No.: WO2014/173837
PCT Pub. Date: Oct. 30, 2014

(65) Prior Publication Data

US 2016/0074885 A1 Mar. 17, 2016

(30) Foreign Application Priority Data

Apr. 22, 2013 (FR) ..... 13 53636

(51) Int. Cl.
*B05B 5/025* (2006.01)
*B05B 5/04* (2006.01)
(Continued)

(52) U.S. Cl.
CPC ..... *B05B 5/0407* (2013.01); *B05B 5/0426* (2013.01); *B05B 5/0533* (2013.01);
(Continued)

(58) Field of Classification Search
CPC ... B05B 5/0407; B05B 5/0535; B05B 5/0426; B05B 5/0533; B05B 15/02
(Continued)

(56) References Cited

U.S. PATENT DOCUMENTS 4,171,100 A 10/1979 Benedek et al.
5,433,387 A * 7/1995 Howe ..... B05B 3/1064 118/629
(Continued)

FOREIGN PATENT DOCUMENTS

CN 1101305 A 4/1995
CN 1292731 A 4/2001
(Continued)

OTHER PUBLICATIONS

International Search Report for PCT/EP2014/057995 dated Aug. 22, 2014.

*Primary Examiner* — Alexander Valvis
(74) *Attorney, Agent, or Firm* — Pearne & Gordon LLP

(57) ABSTRACT

An electrostatic spray device for spraying a liquid coating product, including a rotating bowl and a device for driving the bowl around a rotational axis, the bowl defining a concave surface for distributing the coating product and an edge which limits an area for the spraying the coating product. The spray device includes an electrode that charges by ionization of drops of the coating product. The electrode is arranged, in relation to the edge and along the rotational axis, opposite the spray area, between the edge and the device for driving the bowl. A second electrode mounted on a stationary body allows the creation of an electrostatic field for transporting drops. A third electrode, which is also mounted on a stationary body, is brought to an intermediate potential between those of the first and second electrodes during the operation of the spray device.

18 Claims, 4 Drawing Sheets

Figure 1:
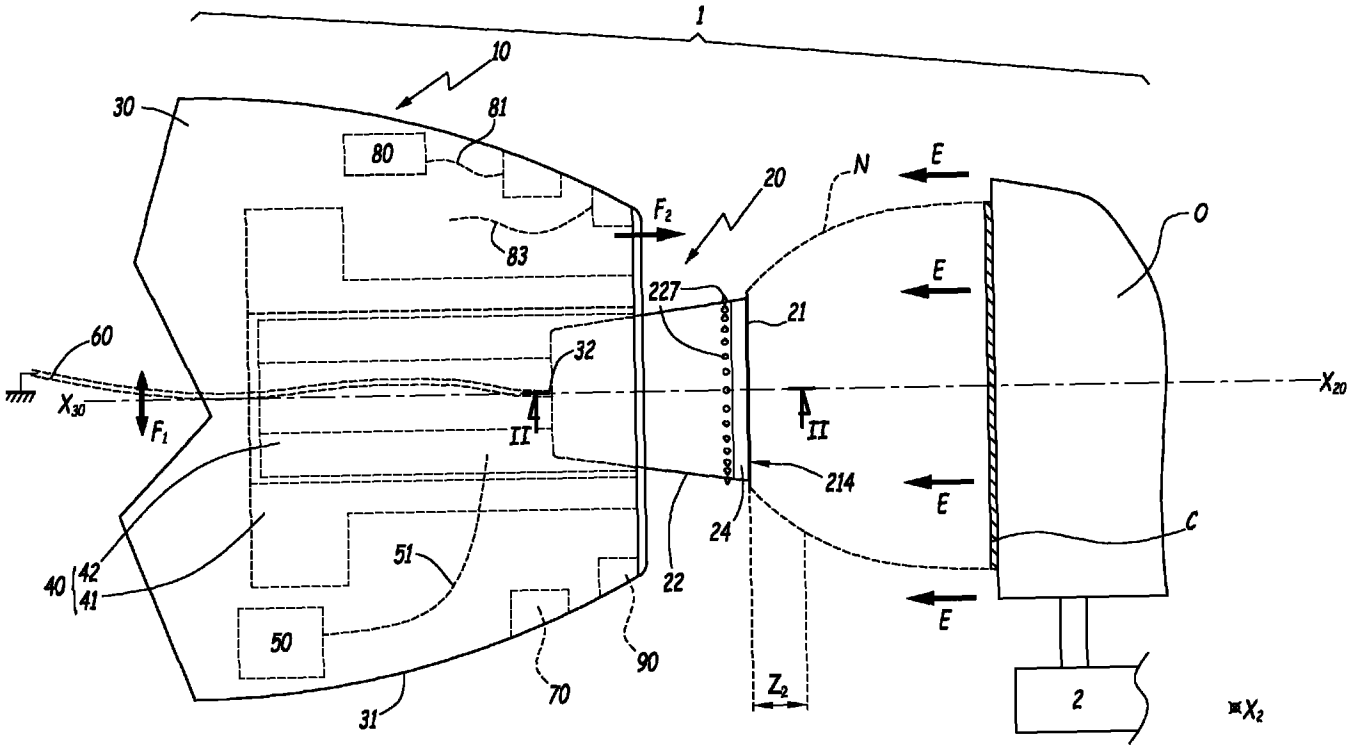

(51) Int. Cl.
*B05B 5/053* (2006.01)
*B05B 5/08* (2006.01)
*B05B 15/02* (2006.01)
*B05B 5/043* (2006.01)

(52) U.S. Cl.
CPC ..... *B05B 5/0535* (2013.01); *B05B 5/087* (2013.01); *B05B 5/043* (2013.01); *B05B 15/02* (2013.01)

(58) Field of Classification Search
USPC ..... 239/699, 700, 703, 706; 118/621, 625, 118/629, 321, 323
See application file for complete search history.

(56) References Cited

U.S. PATENT DOCUMENTS 5,584,931 A 12/1996 Buhlmann
5,865,380 A * 2/1999 Kazama ..... B05B 3/1064 239/703
6,347,754 B1 2/2002 Prus
7,546,962 B2 * 6/2009 Yamada ..... B05B 5/04 118/629
7,661,610 B2 * 2/2010 Yamada ..... B05B 5/04 118/627
8,443,754 B2 * 5/2013 Yamada ..... B05B 5/0535 118/323
8,962,095 B2 * 2/2015 Tamura ..... B05B 5/032 427/470
2009/0032625 A1 2/2009 Yamada

FOREIGN PATENT DOCUMENTS

CN 101653753 A 2/2010
DE 102004033168 A1 2/2006
EP 0 243 043 A2 4/1987
EP 1038588 A1 9/2000
EP 1800757 A1 6/2007
EP 2213378 A1 8/2010
GB 2306901 A 5/1997
JP S62-289254 A 12/1987
JP S64-11661 A 1/1989
JP H08-187453 A 7/1996
JP H0947692 2/1997
JP H11276937 A 10/1999
JP 2002-509795 A 4/2002
JP 200769136 A 3/2007

* cited by examiner

ELECTROSTATIC SPRAY DEVICE FOR SPRAYING A LIQUID COATING PRODUCT, AND SPRAY FACILITY COMPRISING SUCH A SPRAY DEVICE

This is a National Stage application of PCT international application PCT/EP2014/057995, filed on Apr. 18, 2014 which claims the priority of French Patent Application No. 1353485 entitled "ELECTROSTATIC SPRAY DEVICE FOR SPRAYING A LIQUID COATING PRODUCT, AND SPRAY FACILITY COMPRISING SUCH A SPRAY DEVICE", filed with the French Patent Office on Apr. 22, 2013, both of which are incorporated herein by reference in their entirety.

The present invention relates to an electrostatic spray device for spraying a liquid coating product that comprises, inter alia, means for bringing the liquid coating product to a zone for spraying that product in the form of droplets. The invention also relates to a spray facility for spraying coating product that in turn comprises at least one such sprayer.

In the field of the electrostatic spraying of coating products, it is known to use an electrostatic field to improve the deposition performance during the spraying of coating product in the form of sprayed droplets.

In the case of a so-called "internal" or "contact" charge, the coating product comes into contact with an electrode brought to a non-zero electric potential, such that each droplet of coating product sprayed is assigned an electrostatic charge q when it detaches from the rim of a rotating bowl. When such a droplet thus charged is subjected to an electrostatic field with intensity E, that droplet undergoes a force F with intensity q*E when it detaches from a film of coating product. Such a charge mode causes little dirtying on the sprayer because the electrostatic and aeraulic forces that are applied on the droplets are all oriented in the same direction, i.e., toward the object to be coated. One drawback of this charge mode lies in the fact that, if the coating product is conductive, which is in particular the case for hydrosoluble coating products, it is necessary to isolate the sprayer brought to the high voltage from the supply system for supplying coating product at the earth potential. To do that, it is known, for example from EP-A-0,274,322, to use one or more reservoirs onboard a multiaxial robot, which is globally satisfactory, but makes a facility for spraying coating product that incorporates such a system more complex.

In the case of the so-called "external" or "Corona" charge, the droplets of coating product that leave the rotating bowl pass in the vicinity of electrodes brought to a non-zero electric potential, such that they encounter ions bombarded by the electrodes and end up being electrostatically charged and attracted by the object to be coated, which is at the earth potential. This charging mode makes it possible to keep the coating product at the earth potential for spraying, without risk of short-circuiting the generator. It is, however, very sensitive to dirtying of the electrodes and the deposition performance depends on outside conditions such as humidity, outside temperature, spraying speed, etc.

It is known from JP-A-11,276,937 to equip an outer surface of a bowl of a sprayer with electrodes made from a semi-conductive material and that are charged without contact with a point-shaped electrode.

It is also known from EP-A-2,213,378 to use two series of electrodes mounted on a stationary body of a rotating sprayer, those two series of electrodes being respectively supplied by two voltage sources.

In the known materials, lines of an electrostatic field used to transport droplets of coating product can reform on a charge electrode of that product, which decreases the effectiveness of the charge and the transport phenomenon.

The present invention aims to offset the drawbacks of the "internal" and "external" charge modes considered above, while being applicable to electrically conductive coating products and avoiding closing of the transport field lines on a charge electrode.

To that end, the invention relates to an electrostatic sprayer for spraying a liquid coating product, that sprayer comprising a rotating bowl and means for driving that bowl around a rotation axis, the bowl defining a concave surface for distributing the coating product and a rim that delimits a spraying zone for the coating product. The sprayer is equipped with at least one first ionizing charge electrode of droplets of coating product, the ionizing charge electrode being positioned, relative to the rim and along the rotation axis, opposite the spraying zone, between that edge and the means for driving the bowl, and at least one second electrode for creating an electrostatic field to transport droplets toward an object to be coated, that second electrode being mounted on a fixed body of the sprayer. According to the invention, the sprayer comprises a third electrode, also mounted on the stationary body and that is brought to an intermediate electric potential between those of the first and second electrodes during the operation of the sprayer.

Owing to the invention, the droplets of coating product that leave the rim of the bowl can be electrostatically charged effectively, which makes it possible to next use an electrostatic phenomenon to steer those droplets toward an object to be coated, within a facility comprising such a sprayer.

According to advantageous but optional aspects of the invention, such a sprayer may incorporate one or more of the following features, considered in any technically allowable combination:

- The electrode is mounted on the bowl, radially around the inner part of the bowl that defines the concave distributing surface.
- A ring made from an insulating or semi-conductive material is inserted, axially along the rotation axis, between the electrode and the spraying zone.
- The ring defines the spraying rim.
- The ring is inserted between the electrode and an inner part of the bowl defines the spraying rim.
- The ring defines a portion of the outer radial surface of the bowl, between an edge of the electrode turned toward the spraying zone and the spraying rim.
- The inner part of the bowl is made from metal.
- The electrode is provided with at least one ionizing raised portion, in particular ionizing points.
- The electrode is positioned in an air outlet skirt orifice toward the spraying zone.
- The sprayer comprises differentiated control and supply means of the ionizing charge electrode, the second electrode and/or the third electrode.
- A ring made from an insulating or semi-conductive material is inserted, along the rotation axis, between the second electrode and the third electrode.
- A cap made from an insulating or semi-conductive material is inserted, along the rotation axis, between the first and second electrodes, in particular between the first and third electrodes.
- The third electrode is inserted, along the rotation axis, between the first electrode and the second electrode.
- During operation, the electric potentials applied to the second and third electrodes have the same sign.

The invention also relates to a facility for spraying a liquid coating product that comprises at least one sprayer as mentioned above.

Figure 2:
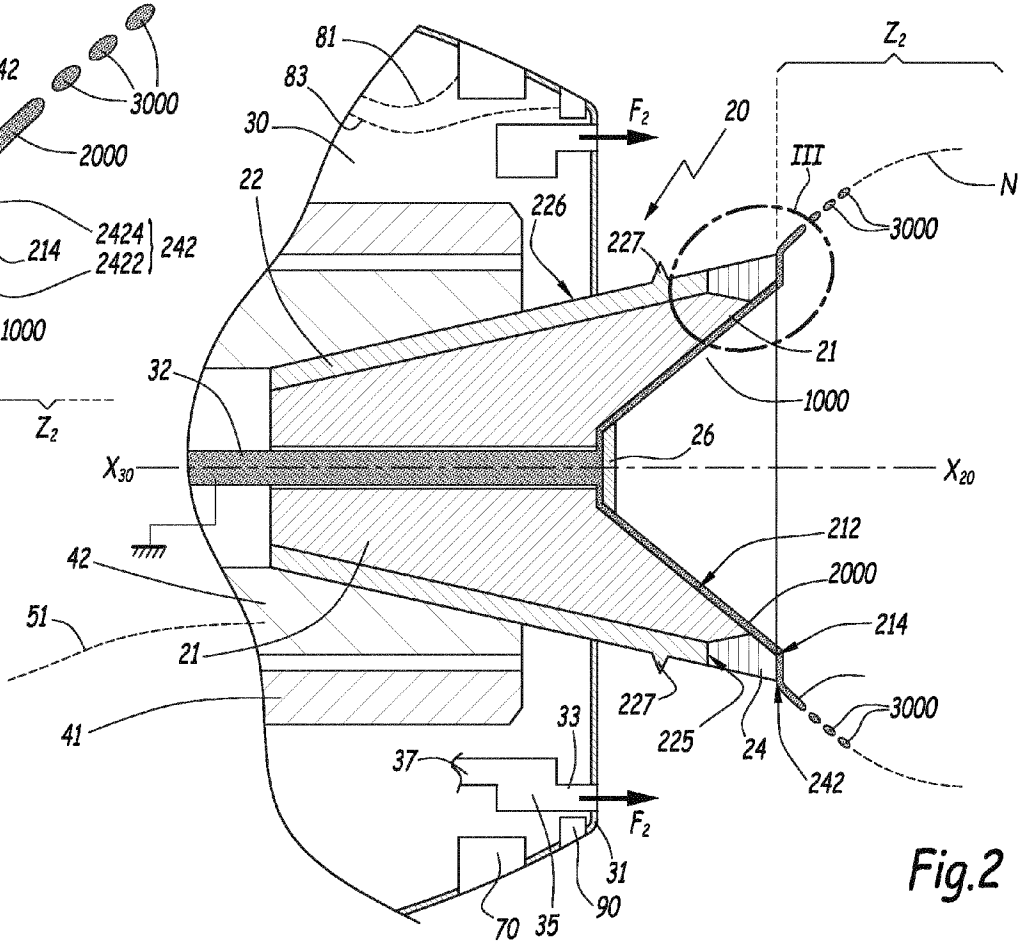
Figure 3:
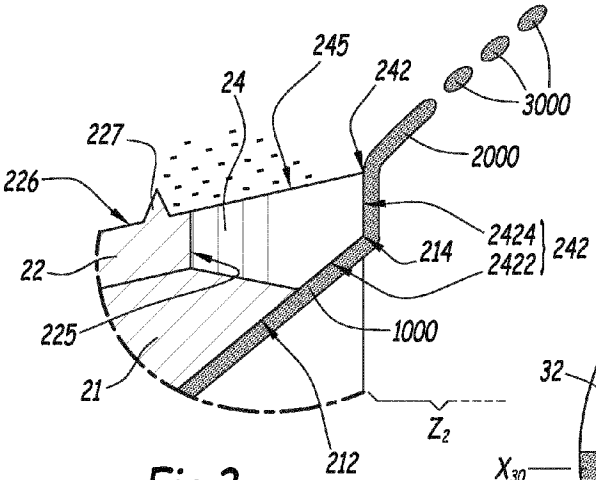
Figure 4:
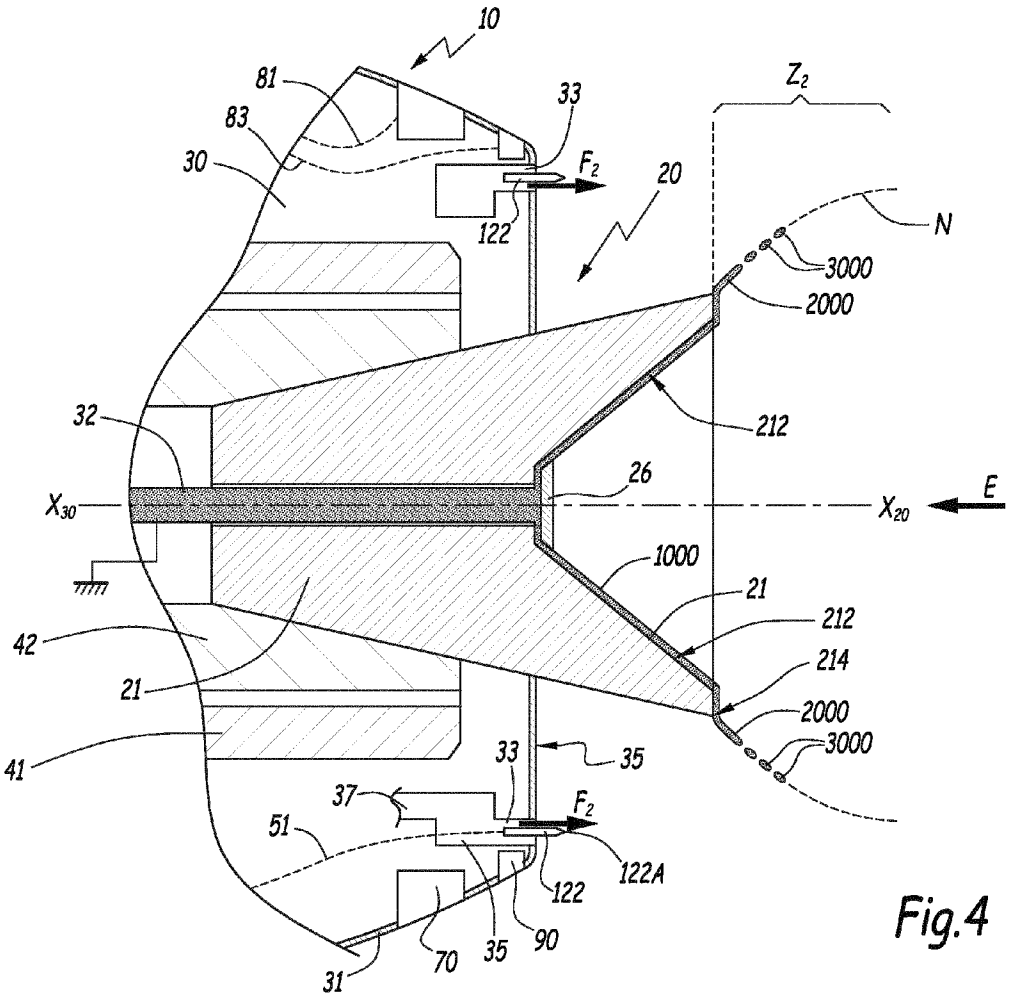
Figure 5:
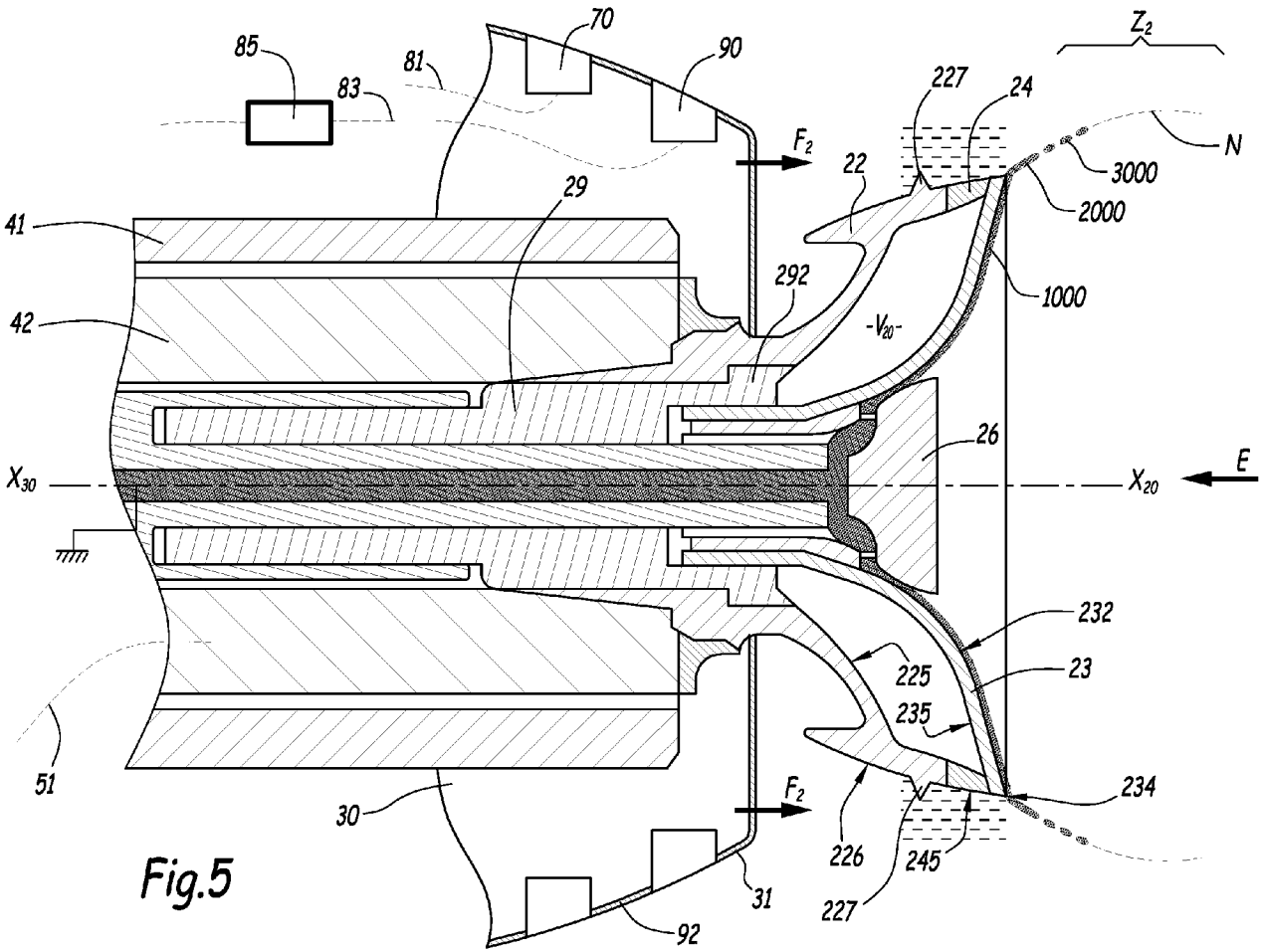

The invention will be better understood and other advantages thereof will appear more clearly in light of the following description of three embodiments of a sprayer according to its principle, provided solely as an example and done in reference to the appended drawings, in which:

FIG. 1 is a diagrammatic block diagram of an electrostatic facility for spraying a coating product according to the invention comprising a rotating sprayer according to the invention, FIG. 2 is a partial and enlarged sectional block diagram, along line II-II in FIG. 1, FIG. 3 is an enlarged view of detail III in FIG. 2, FIG. 4 is a sectional view similar to FIG. 2 for a sprayer according to a second embodiment of the invention, FIG. 5 is a sectional view similar to FIG. 2 for a sprayer according to a third embodiment of the invention.

The facility 1 shown in FIG. 1 comprises a conveyor 2 able to move objects O to be coated along an axis $X_2$ perpendicular to the plane of FIG. 1. In the example of the figures, the object O moved by the conveyor 2 is a motor vehicle body.

The facility 1 also comprises an electrostatic sprayer 10 of the rotary type, and which comprises a bowl 20 forming a spraying member and supported by a body 30 inside which a turbine 40 is mounted for rotating the bowl, around an axis $X_{30}$ defined by the body 30. The turbine 40 comprises a stator 41 and a rotor 42. Reference $X_{20}$ denotes the central axis of the bowl, which is combined with the axis $X_{30}$ in the configuration with the bowl mounted on the turbine 40. The body 30 is considered to be stationary because it does not rotate around the axis $X_{30}$ when the sprayer 10 is operating.

In the present description and irrespective of the embodiment, the front of the sprayer 10 is oriented toward the object O to be coated. Thus, for example, a front part of the sprayer is closer to the object O than a rear part.

The body 30 also contains a high-voltage unit 50 connected to the rotor 42 by a high-voltage cable 51 and supplied by a high-voltage generator that is not shown, but is known in itself. A supply line 60 for supplying the bowl with liquid coating product is also provided in the body 30. This line is connected to a supply source for supplying coating product at the earth potential.

The body 30 is optionally vertically movable, as shown by the double arrow $F_1$, which allows it to perform a sweeping movement. It can also be mounted at the end of the arm of a multiaxial robot.

The sprayer is used to create a cloud N of droplets of coating product and to steer that cloud toward the object O, while depositing a layer C of coating product on that object, the thickness of that layer being exaggerated in FIG. 1 to make it easier to see.

The structure of the bowl 20 can be seen in FIG. 2. It includes a body 21 that defines a surface 212 for distributing the liquid coating product up to a spraying rim 214. The body 21 is made from an electrically insulating material, for example polyether ether ketone (PEEK). The bowl 20 also comprises an outer frame 22 made from metal. A ring 24 is inserted, along the axis $X_{20}$, between the front of the bowl 20 and an edge 225 of frame 22 that is oriented toward the front of the bowl 20. The ring 24 defines a rim 242 for spraying the coating product.

The material of the ring 24 is described as semi-conductive and has a resistivity that allows the flow of electric charges. This resistivity is such that, when a part made from that material is subject to a potential difference U, it is traveled by a current I that is sufficient to slow the electrostatic surface charges. That current I is lower than the maximum current that can be delivered by the generator.

Within the meaning of the present invention, a semi-conductive material has a resistivity comprised between $10^6$ and $10^{14}$ ohm·cm. According to a more restrictive definition, it may be considered that the resistivity of a semi-conductive material is comprised between $10^7$ and $10^{13}$ ohm·cm, or even between $10^9$ and $10^{11}$ ohm·cm. Thus, the electrical properties of a semi-conductive material are clearly different between a conductive material, the resistivity of which is traditionally considered to be less than $10^3$ ohm·cm, and an insulating material, the resistivity of which is traditionally considered to be greater than $10^{15}$ ohm·cm.

As an example, the ring 24 may be made from polyamide filled with carbon fibers, polytetrafluoroethylene (PTFE) filled with conductive particles, or polyether ether ketone (PEEK) filled with conductive particles.

A metal deflector 26 is mounted in a central part of the bowl 20 and makes it possible to deflect the flow of coating product, coming from the line 60 through an injector 32 and centered on the axis $X_{30}$, toward the surface 212.

Alternatively, the deflector 26 may not be made from metal.

Reference $Z_2$ denotes a zone bordered by the spraying rim 244 and which extends, from that rim and along the combined axes $X_{20}$ and $X_{30}$, moving away from the deflector 26, over an axial distance smaller than 10 mm, preferably approximately 5 mm. This zone $Z_2$ constitutes a spraying zone for the liquid coating product, in which droplets 3000 of coating product form, as explained below.

The rotor 42 of the turbine 40 is made from metal and connected to the cable 51, which makes it possible to bring it to the high voltage when the high-voltage unit 50 is active. Since the frame 22 is made from metal, and is therefore electrically conductive, and in contact with the rotor 42, it is also brought to the high voltage in that case. As an example, it is considered that, during operation of the sprayer 10, the frame 22 is brought to a negative high voltage of −20 kV. It then forms a first negative electrode.

The coating product, which is hydrosoluble in this example, flows from the line 60, through the injector 32 that is grounded, then through the deflector 26. This product then forms a film 1000 that is distributed over the surface 212 up to the spraying rim 214, where it forms filaments 2000 that tear into droplets 3000, under the effect of the centrifugal force in particular, in the zone $Z_2$. These droplets then form the cloud N that extends to the object O, along the axis $X_{30}$.

During operation of the sprayer 10, the liquid coating product flows from the supply source at the earth potential toward the outlet orifice of the injector 32 through a line 60 and in the injector 32, where it is kept grounded. It then flows along the surface 212, which is isolated from the electrode 22 by the body 21. After traveling the surface 212, the film 1000 of coating product licks an inner surface 242 of the ring 24 that is formed by a frustoconical segment 2422 and an annular segment 2424 and perpendicular to the axis $X_{30}$. The spraying rim 214 is formed at the junction between the segments 2422 and 2424.

The ring 24 made from a semi-conductive material sufficiently isolates the film 1000 from the frame 22 brought to −20 kV to avoid a short-circuit between that frame and the coating product supply circuit, the line 60 of which is grounded. Thus, the relatively insulating nature of the ring 24 avoids a short-circuit between the means for placing the frame 22 at the high voltage and the ground. The coating product in liquid form thus flows from the supply source at the earth potential to the spraying rim, in the vicinity of which a high-voltage electrode is implanted.

Furthermore, the frame 22 is provided, on its outer peripheral surface 226, with points 227 regularly distributed around the axis $X_{20}$.

During operation, the electrode 22 is brought to a negative high voltage of −20 kV, through the rotor 42. Due to this negative high voltage, negative ions are created in the vicinity of the points 227 toward the spraying rim 214. These ions, represented by "−" signs in FIG. 3, result in negatively charging the filaments of coating product 2000 and droplets of coating product 3000 being formed in the zone $Z_2$. Thus, the electrode 22 constitutes a charge electrode for the droplets 3000 by ionization, or Corona effect, when they form in the zone $Z_2$.

In other words, the use of the ring 24 made from semi-conductive material makes it possible, owing to its relatively insulating nature, to charge the paint droplets 3000 by ionization in the zone $Z_2$.

Alternatively, the ring 24 can be made from an electrically insulating material.

It will be noted that the electrode formed by the frame 22 is positioned on the outside of the bowl and that it radially surrounds the body 21.

The sprayer 10 comprises lines 33 arranged in the body 30 to create an air skirt for shaping the cloud N of droplets 3000 toward the object O. This air skirt flows from the body 30 and toward the front of the sprayer 10, as shown by the arrows $F_2$. The lines 33 are regularly distributed around the axis $X_{30}$ and supplied from an annular distributing chamber 35, which in turn is supplied by a hose 37 connected to an air source (not shown). The skirt air $F_2$ in particular licks the outer radial surface 245 of the ring 24. This results in continuously drying that surface and prevents the generation of electrostatically charged droplets 3000 on that surface, which limits the risks of short-circuit.

The skirt air $F_2$ also licks the outer radial surface 226 of the frame 22, which also results in drying it.

The skirt air also drives the negative ions from the points 227 forward, i.e., toward the zone $Z_2$, where they encounter the droplets 3000, which they then negatively charge.

The sprayer 10 is also equipped with a second annular electrode 70 that is mounted on the body 30, behind the rim 214, i.e., opposite the object O relative to that rim, in the usage configuration of the facility 1. The electrode 70 is supplied with high voltage from a high-voltage unit 80 to which it is connected by a cable 81.

During the operation of the sprayer 10, the electrode 70 is brought to the high voltage, with the same sign as that of the potential of the frame 22. In the example, the electrode 70 is brought to a potential of −80 kV, such that an electrostatic field E is created between the object O and the electrode, that field in particular applying in the zone $Z_2$ where the droplets 3000 leave the spraying rim 214 of the bowl 20. The droplets 3000, which are charged, are then subjected to an aeraulic force due to the skirt air and an electrostatic force whose intensity is equal to their charge q multiplied by the intensity of the electrostatic field E, that force tending to drive the droplets 3000 toward the object O. In that sense, the electrode 70 pushes the droplets 3000 back toward the object O and can be described as a repelling electrode, while the field E can be described as a transport field.

The sprayer is also equipped with a third electrode 90, inserted along the axis $X_{30}$, between the electrodes 22 and 70 and brought to an intermediate potential between the potentials of those electrodes. The function of this third electrode is explained below, in reference to the third embodiment.

In the second and third embodiments of the invention shown in FIG. 4 and following, the elements similar to those of the first embodiment bear the same references. In the following, we essentially describe what distinguishes each of these embodiments from the first embodiment.

In the second embodiment of the invention shown in FIG. 4, a bowl 20 is used that comprises an insulating body 21 defining a surface 212 for distributing a film 1000 of liquid coating product as well as a spraying rim 214 that borders a zone $Z_2$ defined as above and in which droplets 3000 of coating product form from webs 2000 pulled from the film 1000.

Electrodes 122 are positioned in lines 33 by which an air skirt shown by the arrows $F_2$ emerges and that is designed to shape the cloud N of droplets of coating product 3000. The electrodes 122 are made from metal, in the shape of a finger and each having a slender front tip 122A, which favors the ionization phenomenon of the air in the vicinity of those electrodes. The electrodes 122 are electrically connected to one another and to a high-voltage unit by a cable 51. These electrodes 122 therefore make it possible, by ionization, to charge the droplets that form and cross through the zone $Z_2$.

As in the first embodiment, a repelling electrode 70 is provided in the body 30 of the sprayer, which makes it possible to create an electrostatic field E for transporting droplets 3000 of coating product that are negatively charged, toward an object O to be coated.

In this embodiment, the electrodes 122 may be brought to a potential of −20 kV, while the repelling electrode 70 is brought to electric potential of −80 kV during operation of the sprayer 10.

Alternatively, the electrodes 122 may not protrude relative to the front face 35 of the body 30 of the sprayer 10, which is oriented toward the object to be coated.

According to another alternative, the electrodes 122 can be positioned outside the lines 33, radially to the inside or outside of a geometric circle centered on the axis $X_{30}$ and along which those lines are positioned.

In all cases, the electrodes 122 are situated, along the axis $X_{30}$, between the electrode 70 and the spraying rim 214.

Also in this embodiment, the sprayer is equipped with a third electrode 90 inserted, along the axis $X_{30}$, between the electrodes 122 and 70 and brought to an intermediate potential between the potentials of those electrodes. The function of this third electrode is also explained below.

In the first and second embodiments, the body 30 is equipped with a cap 31 made from an electrically insulating material, that cap being provided with a passage opening for the repelling electrode 70. The cap 31 extends in particular, along the axis $X_{30}$, between the electrode 70 and the front of the body 30 by which the skirt air $F_2$ exits. It is therefore inserted, along that axis, between the ionizing charge electrode 22 or 122 and the repelling electrode 70.

In the third embodiment of FIG. 5, the bowl 20 comprises an outer frame 22 made from an electrically conductive material, in particular metal, as well as a distributor 23, also made from metal and the inner radial surface 232 of which constitutes a distributing surface of the film 1000 of coating product up to a spraying rim 234 defined at the outer radial edge of the distributor 23. A ring 24 made from an electrically insulating material or semi-conductive material is inserted, on the outside of the bowl 20, between the frame 22 and the outer radial part of the distributor 23. An annular volume $V_{20}$ is defined between the outer radial surface 235 of the distributor 23 and the inner radial surface 225 of the frame 22.

As in the first embodiment, the rotor 42 of the turbine 40 is brought to the high voltage. This rotor is in contact with the frame 22, which is therefore also brought to the high voltage and forms an electrode.

Furthermore, the bowl 20 comprises a hub 29 made from an electrically insulating material and that serves as an interface with the rotor 42, that hub extending by a collar 292 inserted radially between the frame 22 and the distributor 23, on the side of the volume $V_{20}$ oriented toward the rotor 42. Thus, the ring 24, the volume $V_{20}$ and the collar 292 ensure galvanic ionization between the electrode 22 and the distributor 23, which can be brought to different electric potentials.

Alternatively, the ring 24 and/or the hub 29 may be made from a semi-conductive material.

On its outer peripheral surface 226, the electrode 22 is provided with a series of points 227 that extends radially outward relative to the axis $X_{30}$. Alternatively, the series of points 227 may be replaced by a sharp circular rim.

The bowl 20 also comprises a metal deflector 26 comparable to that of the first embodiment.

During operation, the electrode 22 is brought to a negative high voltage of −20 kV, through the rotor 42. Due to that negative high voltage and as in the first embodiment, negative ions are created in the vicinity of the points 227, by ionization of the ambient air. Thus, the electrode 22 constitutes a charge electrode for the droplets 3000 by ionization, or Corona effect, when they form in the zone $Z_2$.

It will be noted that the electric potential of the distributor 23 and deflector 26 may be floating, since the distributor 23 and the deflector are electrically isolated from the electrode 22. The elements 23 and 26 are made from metal in order to have a good abrasion resistance with respect to the coating product.

In the case where the ring 24 is electrically insulated, it makes it possible to maintain a potential difference between the distributor 23 and the electrode 22, on either side of the ring 24.

Furthermore, a second electrode 70, called repelling electrode, is mounted on the body 30 and brought to −80 kV during operation of the sprayer. It creates an electrostatic field E for transporting the droplets 3000 toward an object O to be coated. The droplets 3000, which are negatively charged, move up the electrostatic field while being "repelled" by the electrode 70.

As before, a flow of skirt air shown by the arrows $F_2$ is used to shape the cloud N of droplets that forms in the zone $Z_2$. The skirt air jet makes it possible to continuously dry the outer radial surface 226 and the points 227 of the electrode 22 as well as the outer radial surface 245 of the ring 24, which prevents the accumulation of droplets and limits the risks of short-circuit. Means like those 33, 35 and 37 of the first embodiment are used to create the skirt air flow.

As in the first embodiment, the body 30 is equipped with a third stabilizing electrode 90 that is positioned, along the axis $X_{30}$, between the electrode 70 and the rim 234 of the bowl 20. In other words, the stabilizing electrode 90 is inserted, along the axis $X_{30}$, between the electrodes 22 and 70, therefore closer to the electrode 22 than the repelling electrode 70. A ring 92 made from an insulating or semi-conductive material is inserted, along the axis $X_{30}$, between the electrodes 70 and 90.

The electrodes 70 and 90 are respectively connected to high voltage sources by cables 81 and 83. One such high voltage source is visible in FIG. 1, in the form of a generator 80 connected to the cable 81. The cable 83 is, in turn, either connected to the generator 80 by means of a voltage divider bridge 85, or connected to a generator specific to it. Other methods of powering the electrode 90 can be considered.

During the operation of the sprayer 10, the electrode 90 is brought to an intermediate potential between that of the ionizing charge electrode 22 and that of the repelling electrode 70. As an example, this intermediate potential may be set at approximately half of the potential of the second electrode, i.e., −40 kV in the example. The stabilizing electrode 90 makes it possible to form a screen with respect to the field lines resulting from the repelling electrode 70, which thus do not tend to close on the charge electrode 22. This prevents the electrostatic field created by the repelling electrode 70 from disrupting the ionization phenomenon of the droplets 3000 in the zone $Z_2$.

In practice, the potentials of the second and third electrodes have the same sign and the potential of the third electrode 90 may be chosen to be between 0% and 90% of that of the second electrode 70.

The preceding observations are also valid for the first and second embodiments.

The cap 31 of this embodiment extends between the electrode 90 and the front of the body 30. It is therefore axially inserted between the electrodes 22 and 70, more particularly between the electrodes 22 and 90. This cap is, in turn, made from an insulating material.

In the embodiment of FIG. 5, the means for bringing the skirt air $F_2$ behind the bowl are not shown. They may be identical to or different from those of the first and second embodiments.

Irrespective of the embodiment, the ionizing charge electrode, i.e., the frame 22 in the first embodiment, the electrodes 122 in the second embodiment and the electrode 22 in the third embodiment, extend(s) at least partially between the spraying rim 214 and the rotor 42 of the turbine 40, along the axis $X_{30}$. Thus, this ionizing electrode is correctly positioned to effectively charge the droplets 3000 of coating product that pass through the spraying zone $Z_2$.

Irrespective of the embodiment, the first charge electrode on the one hand, and the second and third electrodes for creating the field E for transporting and stabilizing on the other hand, can be supplied with electric voltage at different moments. In other words, they can be activated separately. For example, to penetrate a part forming a Faraday cage, such as an optical beacon housing, it is possible to reduce the transport field by decreasing or zeroing out the absolute value of the supply voltages of the second and third electrodes, favoring the charge by the first electrode, so that the droplets 3000 penetrate the Faraday cage. The principle consists of activating the first, second and third electrodes independently of one another, based on the geometry of the object O to be coated. It is also possible to activate the second electrode or modify its potential on the fly, during spraying, since the response times of the charge means are approximately 200 ms, which is compatible with the typical movement speeds of a sprayer relative to an object to be coated.

To that end, the high voltage units 50 and generators 50 and 80 of the first embodiment and their control means, or the similar means used in the other embodiments, constitute control and supply means that are differentiated and independent from the charge electrodes 22 or 122 and electrodes 70 for creating the transport field E. Likewise, the generators 80 and equivalent devices of the first embodiment and their control means, as well is the similar means used in the other embodiments, constitute control and supply means that are differentiated and independent of the second and third electrodes 70 and 90.

However, alternatively, the first, second and third electrodes may be supplied by outlets with different levels of the same electrostatic generator 80.

The invention is particularly applicable in the case where the sprayer is of the gun type, i.e., designed to be held in an operator's hand. It is also applicable to automatic sprayers.

The invention has been described in reference to embodiments in the case where the potential of the electrodes is negative. It can, however, be implemented in the case where that potential is positive.

The technical features of the embodiments and alternatives considered above may be combined with one another to create new embodiments.

The invention claimed is:

1. An electrostatic sprayer for spraying a liquid coating product, said sprayer comprising a rotating bowl and means for driving said bowl around a rotation axis, the bowl defining a concave surface for distributing the coating product and a rim that delimits a spraying zone for the coating product, the sprayer being equipped with supply means, at least one first ionizing charge electrode positioned, relative to the rim and along the rotation axis, opposite the spraying zone, between said rim and the means for driving the bowl, said first ionizing charge electrode being configured for charging droplets of coating product, said supply means being configured to bring said first ionizing charge electrode to a first electric potential, at least one second electrode mounted on a stationary body of the sprayer for creating an electrostatic field to transport droplets toward an object to be coated, said supply means being configured to bring said second electrode to a second electric potential different from the first electric potential, and a third electrode, also mounted on the stationary body, said supply means being configured to bring the third electrode to an intermediate electric potential between the first electric potential and the second electric potential during the operation of the sprayer.

2. The sprayer according to claim 1, wherein the first electrode is mounted on the bowl, radially around an inner part of the bowl that defines the concave distributing surface.

3. The sprayer according to claim 2, wherein a ring made from an insulating or semi-conductive material is inserted, axially along the rotation axis, between the first electrode and the spraying zone.

4. The sprayer according to claim 3, wherein the ring defines the spraying rim.

5. The sprayer according to claim 3, wherein the ring is inserted between the first electrode and said inner part of the bowl that also defines the rim.

6. The sprayer according to claim 3, wherein the ring defines a portion of an outer radial surface of the bowl, between an edge of the first electrode turned toward the spraying zone and the spraying rim.

7. The sprayer according to claim 2, wherein the inner part of the bowl is metal.

8. The sprayer according to claim 2, wherein the first electrode is provided with at least one ionizing raised portion.

9. The sprayer according to claim 1, wherein the first electrode is positioned in an air outlet skirt orifice toward the spraying zone.

10. The sprayer according to claim 1, wherein another ring made from an insulating or semi-conductive material is inserted, along the rotation axis, between the second electrode and the third electrode.

11. The sprayer according to claim 1, wherein a cap made from an insulating or semi-conductive material is inserted, along the rotation axis, between the first and second electrodes.

12. The sprayer according to claim 1, wherein the third electrode is inserted, along the rotation axis, between the first electrode and the second electrode.

13. The sprayer according to claim 1, wherein during operation, the electric potentials applied to the second and third electrodes have the same sign.

14. A facility for spraying a liquid coating product, wherein it comprises at least one sprayer according to claim 1.

15. The sprayer according to claim 1, wherein the supply means include three different electrostatic generators respectively connected to the three electrodes.

16. The sprayer according to claim 1, wherein the supply means include two different electrostatic generators, one electrostatic generator being connected to two electrodes with one of these two electrodes being connected to this generator via a voltage divider bridge.

17. The sprayer according to claim 1, wherein the supply means includes an electrostatic generator and three electrodes are supplied with different levels of said electrostatic generator.

18. The sprayer according to claim 11, wherein the cap is inserted between the first and third electrodes.

* * * * *